US007553395B2

(12) United States Patent
Stoffel et al.

(10) Patent No.: US 7,553,395 B2
(45) Date of Patent: Jun. 30, 2009

(54) PRINT MEDIA AND METHODS OF MAKING PRINT MEDIA

(75) Inventors: John L Stoffel, San Diego, CA (US); Bill Sperry, San Diego, CA (US); Richard J McManus, San Diego, CA (US); Hai Q Tran, San Diego, CA (US); Yi-Hua Tsao, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 530 days.

(21) Appl. No.: 10/817,141

(22) Filed: Apr. 2, 2004

(65) Prior Publication Data

US 2005/0217815 A1 Oct. 6, 2005

(51) Int. Cl.
*D21H 17/56* (2006.01)

(52) U.S. Cl. ..... 162/164.6; 162/158; 162/181.2; 162/183; 162/184

(58) Field of Classification Search ..... 162/158, 162/164.6, 181.2, 183, 184
See application file for complete search history.

(56) References Cited

U.S. PATENT DOCUMENTS

| | | | | | |
|---|---|---|---|---|---|
| 4,168,165 | A | * | 9/1979 | Kato et al. | 430/63 |
| 4,554,181 | A | | 11/1985 | Cousin et al. | |
| 4,904,507 | A | | 2/1990 | Greenwood | |
| 5,372,884 | A | * | 12/1994 | Abe et al. | 428/32.36 |
| 5,500,668 | A | * | 3/1996 | Malhotra et al. | 347/105 |
| 5,709,976 | A | | 1/1998 | Malhotra | |
| 5,714,270 | A | * | 2/1998 | Malhotra et al. | 428/32.11 |
| 5,897,961 | A | | 4/1999 | Malhotra et al. | |
| 5,908,728 | A | | 6/1999 | Sakaki et al. | |
| 6,084,619 | A | | 7/2000 | Takemoto et al. | |
| 6,197,880 | B1 | | 3/2001 | Nigam | |
| 6,261,353 | B1 | * | 7/2001 | Doi et al. | 106/31.6 |
| 6,291,023 | B1 | * | 9/2001 | Nigam | 427/389.9 |
| 6,412,940 | B1 | * | 7/2002 | Inoue et al. | 347/101 |
| 6,423,182 | B1 | | 7/2002 | Furunaga et al. | |
| 6,455,137 | B1 | | 9/2002 | Miyamoto et al. | |
| 6,478,980 | B2 | * | 11/2002 | Nigam | 252/8.61 |
| 6,485,139 | B1 | | 11/2002 | Lavery et al. | |
| 6,537,650 | B1 | * | 3/2003 | Waller et al. | 428/195.1 |
| 6,660,369 | B2 | | 12/2003 | MacMillan | |
| 6,686,054 | B2 | | 2/2004 | Nigam | |
| 6,761,977 | B2 | | 7/2004 | Nigam | |
| 2002/0140796 | A1 | * | 10/2002 | Sumioka et al. | 347/105 |
| 2003/0059636 | A1 | | 3/2003 | Nigam | |
| 2003/0062506 | A1 | * | 4/2003 | Nigam | 252/8.61 |
| 2003/0082473 | A1 | * | 5/2003 | Nakamura et al. | 430/124 |
| 2003/0087112 | A1 | * | 5/2003 | Nigam | 428/457 |
| 2003/0219539 | A1 | * | 11/2003 | Nigam | 427/372.2 |
| 2004/0202832 | A1 | * | 10/2004 | Nigam et al. | 428/195.1 |

FOREIGN PATENT DOCUMENTS

| | | |
|---|---|---|
| EP | 1 172 224 A1 | 1/2002 |
| EP | 1172224 | 1/2002 |
| JP | 61-10484 | 1/1986 |
| JP | 2002-512314 | 4/2002 |
| WO | W000/58107 | 10/2000 |
| WO | WO2004005039 | 1/2004 |

* cited by examiner

*Primary Examiner*—Steven P Griffin
*Assistant Examiner*—Dennis Cordray

(57) ABSTRACT

Print media and methods of making print media are disclosed. One exemplary print medium, among others, includes a substrate having a fibrous component. In addition, a cationic guanidine polymer compound or salt thereof and a metallic salt are each disposed within the fibrous component of the substrate.

28 Claims, 5 Drawing Sheets

PRINT MEDIA AND METHODS OF MAKING PRINT MEDIA

BACKGROUND

As printing technology advances, paper manufacturers are faced with the increasingly rigorous demands of their customers for high quality paper that is economically attractive. For example, there is a great demand for paper of high enough quality to be suitable for printing of a digital image with an ink-jet printer where the look and durability of the product approaches that of a laser printer. Thus, there is a keen demand for papers that meet high quality standards with respect to brightness, opacity, and dry and/or wet strength, and that, upon printing with any of a wide range of colorants, provide a water-resistant and vivid printed image. Customers further demand that such papers be amenable to use with a variety of printing techniques, including not only conventional printing techniques, but also "impact free" printing techniques such as inkjet printing (particularly colored inkjet printing), laser printing, photocopying, and the like.

Current issues with thermal ink-jet printing and the media it is printed on include waterfastness and dripfastness. Most papers that are printed with thermal ink-jet inks do not effectively bind with the dyes. Upon exposure to aqueous solutions (e.g., water), the ink is resolubilized creating a page attribute defect such as smear which destroys the print quality. Another issue with thermal ink-jet printing is optical density. In order to achieve black optical density or color saturation, a large amount of the dye/pigment have to be used. Most dyes/pigments penetrate into the paper and do not stay on the surface. An approach to keep the dyes/pigment on the surface of the paper would greatly enhance optical density and ultimately, reduce the amount of dyes/pigment used in thermal ink-jet printing. This could effectively reduce the cost per page to print.

SUMMARY

Briefly described, embodiments of this disclosure include print media and method of making print media. One exemplary print medium, among others, includes a substrate having a fibrous component. In addition, a cationic guanidine polymer compound or salt thereof and a metallic salt are each disposed within the fibrous component of the substrate.

Methods of making print media are also provided. One exemplary method, among others, includes: providing a fibrous component including a plurality of fibers; providing a cationic guanidine polymer compound or salt thereof and a metallic salt; introducing the cationic guanidine polymer compound or salt thereof and the metallic salt to the fibrous component; mixing the cationic guanidine polymer compound or salt thereof and the metallic salt with the fibrous component, wherein the cationic guanidine polymer compound or salt thereof and the metallic salt are disposed within the fibers of the fibrous component; and forming a substrate including the cationic guanidine polymer compound or salt thereof and the metallic salt disposed with the fibers of the fibrous component.

BRIEF DESCRIPTION OF THE DRAWINGS

Many aspects of this disclosure can be better understood with reference to the following drawings. The components in the drawings are not necessarily to scale. Moreover, in the drawings, like reference numerals designate corresponding parts throughout the several views.

DETAILED DESCRIPTION

Figure 1:
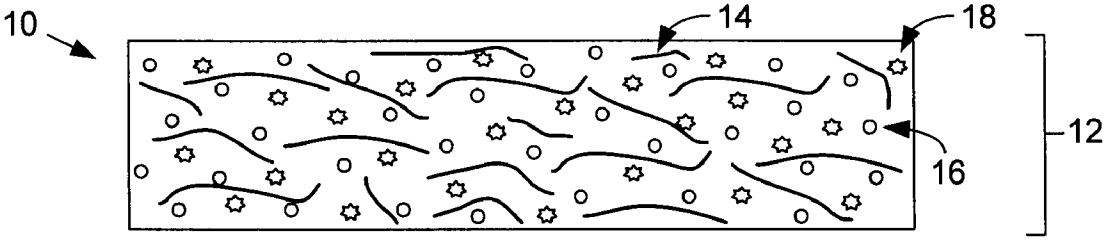
FIG. 1 illustrates a representative embodiment of a print medium.

A. In describing the present disclosure, the following terminology will be used.

The term "substrate", "print substrate", "print media" is meant to encompass a substrate based on cellulosic fibers, synthetic fibers (e.g., polyamides, polyesters, polyethylene, and polyacrylic fibers), inorganic fibers (e.g., asbestos, ceramic, and glass fibers), and any combination of thereof. The substrate may be of any dimension (e.g., size or thickness) or form (e.g., pulp, wet paper, dry paper, etc.). The substrate is preferably in the form of a flat or sheet structure, which structure may be of variable dimensions (e.g., size and thickness). In particular, substrate is meant to encompass printing paper (e.g., inkjet printing paper, etc.), writing paper, drawing paper, photobase paper, and the like, as well as board materials such as cardboard, poster board, Bristol board, and the like.

The term "sheet" or "flat structure" is not meant to be limiting as to dimension, roughness, or configuration of the substrate, but rather is meant to refer to a product suitable for printing.

As used herein, "optical density" refers to the fullness and intensity characteristics of an inkjet ink after application to a print substrate. These visual effects are generally a measure of the concentration of ink at a given point on a print substrate. Optical density may in one aspect be calculated as the negative log of the ratio of the light reflected off of the print media divided by the amount of light incident on the print substrate.

The terms "waterfast" and "dripfast" are used herein to describe a form of water resistance, and which is normally used to refer to the nature of the ink composition after drying on a substrate. In general, waterfast and dripfast mean that the dried composition is substantially insoluble in water, such that upon contact with water, the dried ink retains at least about 70%, preferably at least about 85%, and more preferably at least about 95%, of optical density. In particular, waterfast generally refers to full immersion on the media in water, while dripfast refers to droplets of water dropped onto the media.

The term "alkyl" as used herein refers to a branched or unbranched saturated hydrocarbon group of 1 to 24 carbon atoms, such as methyl, ethyl, n-propyl, isopropyl, n-butyl, isobutyl, t-butyl, octyl, decyl, tetradecyl, hexadecyl, eicosyl, tetracosyl, and the like, as well as cycloalkyl groups such as cyclopentyl, cyclohexyl and the like. The term "lower alkyl" intends an alkyl group of 1 to 6 carbon atoms, preferably 1 to 4 carbon atoms.

The term "alkoxy" as used herein intends an alkyl group bound through a single, terminal ether linkage; that is, an "alkoxy" group may be defined as "OR" where R is alkyl as defined above. A "lower alkoxy" group includes an alkoxy group containing 1 to 6 carbon atoms.

"Halo" or "halogen" refers to fluoro, chloro, bromo or iodo, and usually relates to halo substitution for a hydrogen atom in an organic compound.

The term "polymer" is used herein in its conventional sense to refer to a compound having two or more monomer units, and is intended to include homopolymers as well as copolymers. The term "monomer" is used herein to refer to compounds that are not polymeric.

B. Print media and methods for fabricating the print media are provided. Embodiments of this disclosure relate to the print medium having improved print qualities such as waterfastness, dripfastness, gamut, and optical density upon being printed upon using black and/or colored inks (e.g., dye-based and pigment-based inks). In particular, the print medium includes a guanidine polymer compound or salt thereof (hereinafter guanidine polymer, guanidine polymer compound, or cationic guanidine polymer compound) and a metallic salt, where each are disposed within the fibrous material of the print medium. The guanidine polymer compound and the metallic salt are incorporated into the print medium during the print medium making process (e.g., during draw down or incorporated into the bulk slurry) so that the guanidine polymer compound and the metallic salt are disposed within and around the fibrous material and the other components (e.g., fillers and binders).

It should be noted that the guanidine polymer compound and the metallic salt are not formed as a layer disposed on top of the print medium, but rather within the fibrous material of the print medium. In another embodiment, a separate layer can be formed on the print medium having the guanidine polymer compound and the metallic salt disposed therein, which is in addition to the guanidine polymer compound and the metallic salt disposed within the print medium.

FIG. 1 illustrates a cross-sectional view of a representative embodiment of the print medium 10. As mentioned above, the print medium 10 can include, but is not limited to, a substrate 12 including a fibrous component 14, a guanidine polymer compound 16, and a metallic salt 18. The guanidine polymer compound 16 and a metallic salt 18 are disposed within and among the fibrous component 14 and are an integral part of the substrate 12. In addition, the print medium 10 can have additional layers disposed upon the substrate 12. Further, the substrate 12 can include additional components such as, but not limited to, binders, fillers, and the like (not shown for clarity).

By incorporating the guanidine polymer compound 16 and a metallic salt 18 into the fibrous component of the substrate 12, the waterfastness, dripfastness, the gamut, and/or the optical density of the print medium 10 is enhanced relative to some of the other print media currently used. Although not intending to be bound by theory, the addition of the guanidine polymer compound 16 brings the dye out of solution (e.g., causes the dye to crash) and keeps it from solubilizing when it comes into contact with water of various pHs. In order to insolubilize the dye, the guanidine polymer effectively binds with the dye to form a complex salt.

Figure 2:
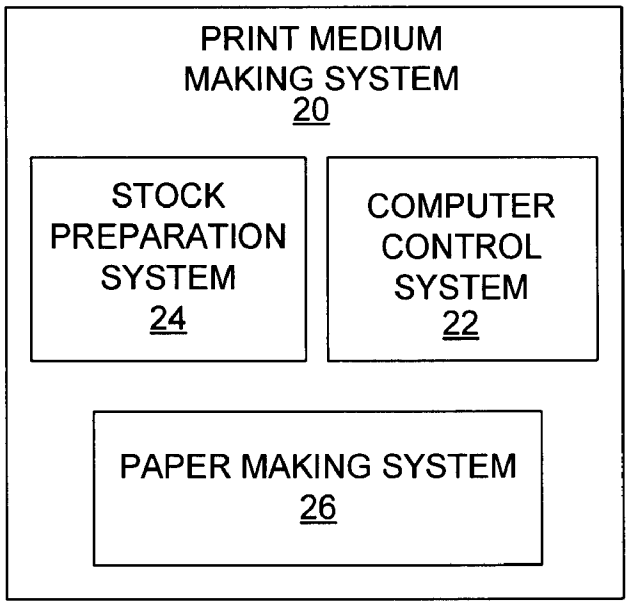
FIG. 2 is a representative embodiment of a print medium making system for making the print medium illustrated in FIG. 1.

FIG. 2 illustrates a block diagram of a representative print medium making system 10 that includes, but is not limited to, a computer control system 22, stock preparation system 24, and a paper machining system 26. The computer control system 22 includes a process control system that is operative to control the stock preparation system 24 and a paper machining system 26. In particular, the computer control system 22 instructs and controls the introduction of the guanidine polymer compound 16 and the metallic salt 18 into the stock preparation system 24 and/or a paper machining system 26.

Figure 3:
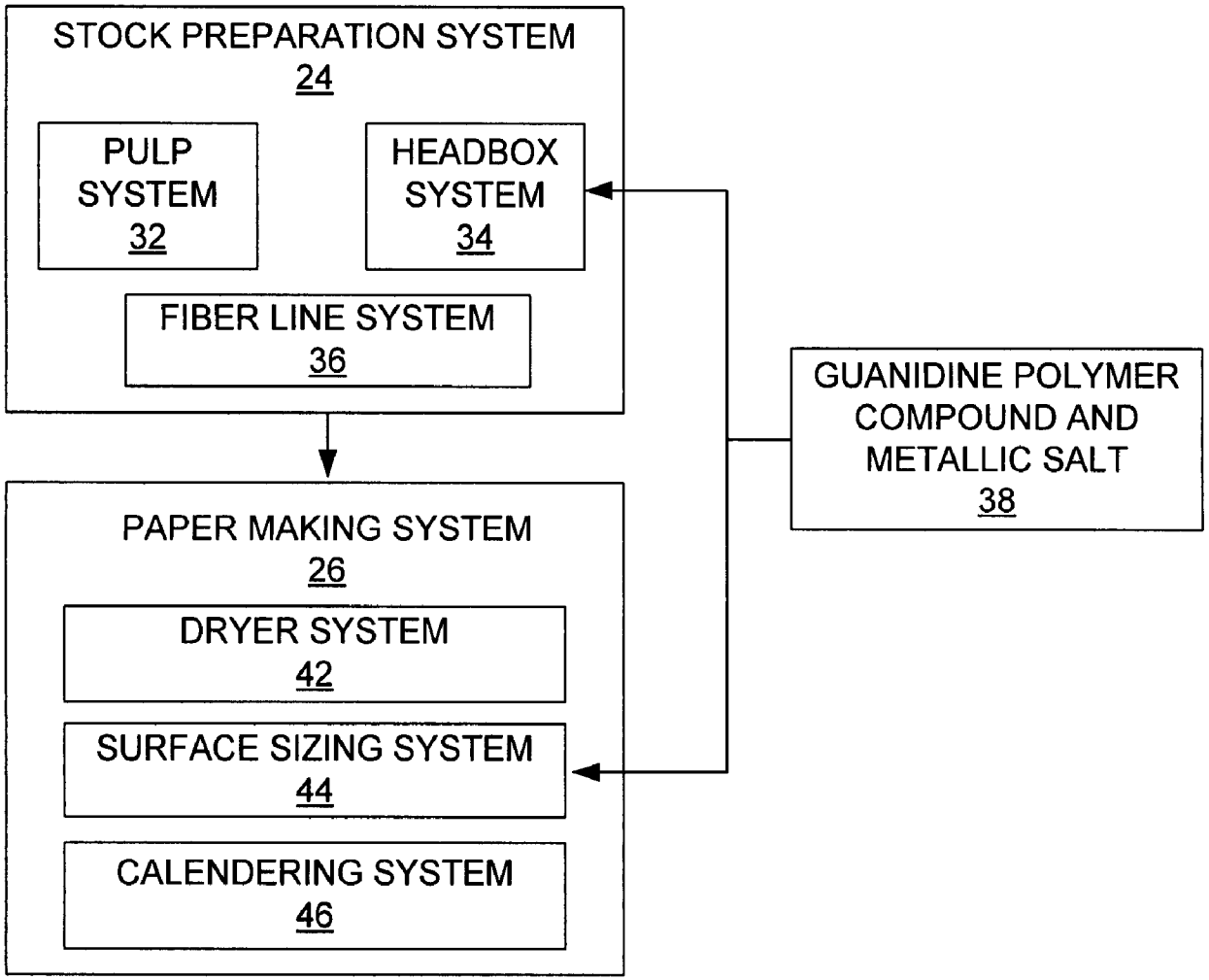
FIG. 3 is a representative embodiment of an aspect of the print medium making system illustrated in FIG. 2.

As shown in FIG. 3, the stock preparation system 24 includes, but is not limited to, a pulp system 32, a headbox system 34, and a fiber line system 36. The pulp system 32 grinds wood stock into a fibrous material. The wood fibers are turned into the fibrous component (e.g., a fibrous pulp) with the addition of water and any other types of solvents in the headbox system 34. The addition of water and/or other solvents creates an emulsion of the fibrous component, which is easier to handle. The guanidine polymer compound 16 and the metallic salt 18 can be introduced in the headbox system 34 as part of the aqueous solution. The fibrous component is flattened into a preset thickness in the fiber line system 36. It should be noted that non-wood fibrous components, as described above, can be used to produce the print media and the use of wood stock is merely illustrative.

The paper machining system includes, but is not limited to a dryer system 42, a surface sizing system 44, and a calendaring system 46. The dryer system facilitates in evaporating the water and other volatiles from the fibrous component. At the surface size press, additional surface sizing compound (e.g., starch, optical brighteners, and the like) can be added to the surface of the paper to achieve a final feel/texture and visual appeal of the print medium. Generally, the surface sizing compound is an aqueous solution that is coated onto the paper. The calendaring tool is used to flatten the print medium to its final thickness as well as smooth the print medium. The guanidine polymer compound 16 and the metallic salt 18 can be added at the surface size press if it's incorporated into an aqueous solution along with other surface sizing components. The solution is easily dispersed into the fibrous component in liquid form and the water is evaporated off at a later stage, leaving each of the guanidine polymer compound 16 and the metallic salt 18 in a solid form bound to the fibrous component.

Figure 4:
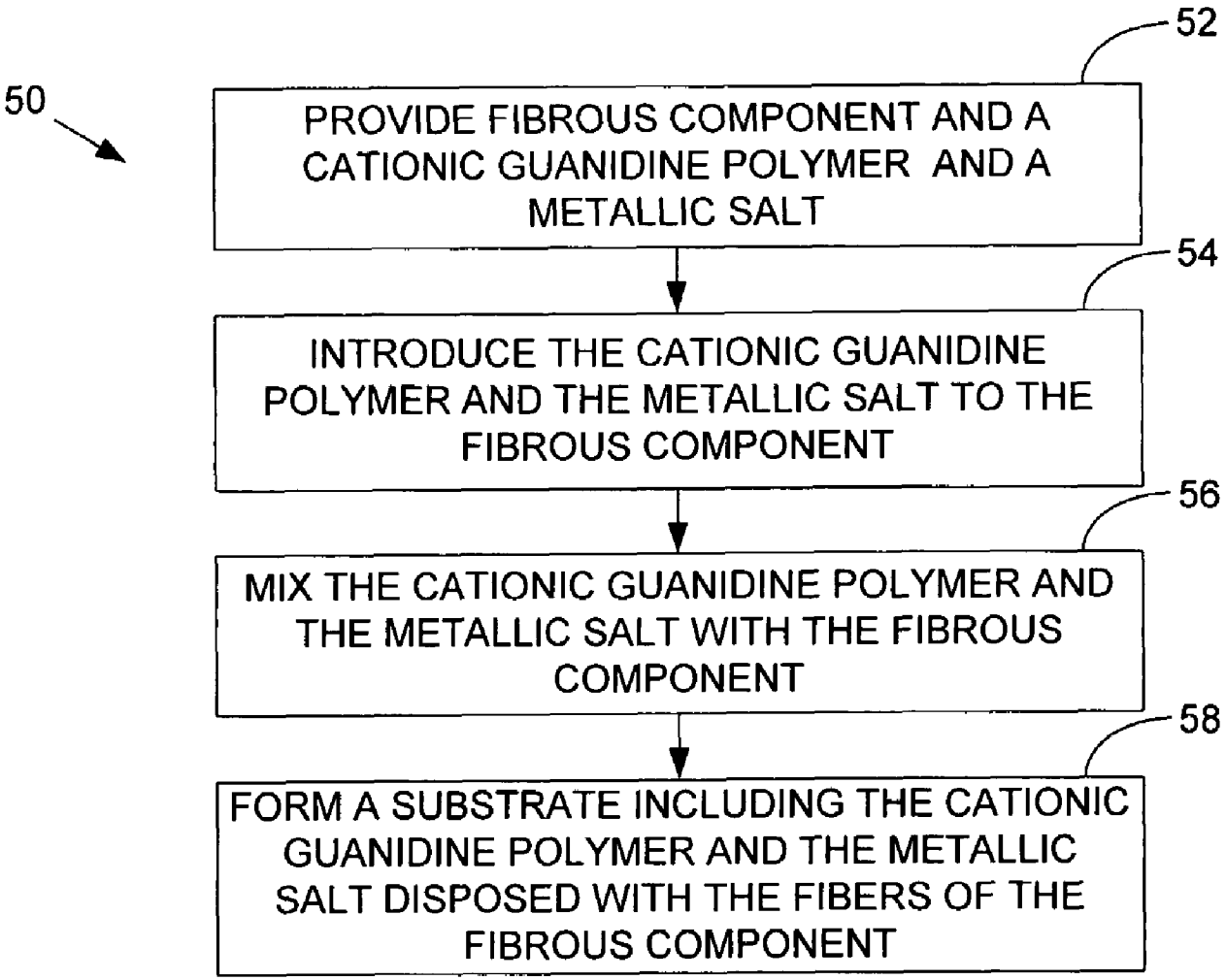
FIG. 4 is a representative flow diagram for an embodiment of a method of forming the print medium in FIG. 1 using the print medium making system of FIGS. 2 and 3.

FIG. 4 is a flow diagram describing a representative method 50 for making the print medium shown in FIG. 1 and described in the corresponding text, using the print medium making system 20. In block 52, fibrous component and a cationic guanidine polymer compound and a metallic salt are provided. In block 54, the cationic guanidine polymer compound and the metallic salt are introduced to the fibrous component. The cationic guanidine polymer compound and the metallic salt can be introduced to the fibrous component at one or more steps of the print medium making process (e.g., during draw down or incorporated into the bulk slurry). In block 56, the cationic guanidine polymer compound and the metallic salt are mixed with the fibrous component. The cationic guanidine polymer compound and the metallic salt are disposed within and among the fibrous component and become an integral part of the substrate 12. In block 58, a substrate is formed, where the substrate includes the cationic guanidine polymer compound and the metallic salt disposed within the fibers of the fibrous component The print medium 10 can be used in a printer system, where a fluid (e.g., ink, dye-based ink and/or pigment based ink) is dispensed onto the print medium 10. The printer system can be a laser printer system or an ink-jet printer system. For example, the ink-jet system includes, but is not limited to, ink-jet technologies and coating technologies, which dispense the ink onto the print media. Ink-jet technology, such as drop-on-demand and continuous flow ink-jet technologies, can be used to dispense the ink. The ink dispensing system can include at least one ink-jet printhead (e.g., thermal ink-jet printhead and/or a piezo ink-jet print head) operative to dispense (e.g., jet) the inks through one or more of a plurality of ink-jet printhead dispensers.

As mentioned above, the substrate 12 includes a guanidine polymer compound (e.g., polyguanidine) or a salt thereof 16. The guanidino group is extremely basic, possessing a pKa of about 12-13. Guanidine polymer compounds 16 are typically provided as acid salts wherein the imine nitrogen atoms are often in a protonated form and are cations.

In general, the guanidine polymer compounds 16 can be either homopolymers or copolymers. The guanidine polymer compounds 16 include one or more monomer units having a structural formula (I) or salts thereof, wherein $R^1$ is hydrogen or a lower alkyl and $R^2$ is hydrogen, an alkyl, an alkoxy, or a hydroxyl-substituted alkoxy. Preferably, $R^1$ and $R^2$ are hydrogen.

I

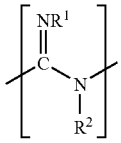

In one embodiment, the guanidine polymer compounds 16 include monomer units having a structural formula (II) or salts thereof, where "n" is an integer in the range of 1 to 10, $R^1$ is hydrogen or a lower alkyl, and $R^2$ is hydrogen, an alkyl, an alkoxy, or a hydroxyl-substituted alkoxy. Preferably, $R^1$ and $R^2$ are hydrogen. Preferred structures of structural formula (II) include compounds where "n" is 6 and the compound is a polyhexylmethylbiguanidine polymer or salt thereof.

II

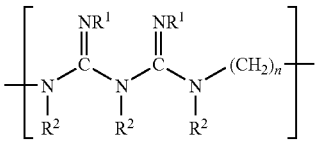

In another embodiment, the guanidine polymer compound 16 has the structure of formula (II) wherein $R^1$ and $R^2$ are H and "n" is 6 (3,12-diimino-2,4, [11,]13-tetraazatetradecanediimidamide).

Although not intending to be bound by theory, the guanidine polymer compounds 16 react electrostatically with anionic groups present in the dye via ion-exchange type interactions.

The guanidine polymer compound 16 can include guanidine oligomers and salts thereof and guanidine derivative compounds. The guanidino portion of such compounds can be very basic, possessing a pKa of up to about 12-13. These compounds are typically provided as acid salts wherein the imine nitrogen atoms are for the most part in a protonated form and are cations.

Exemplary embodiments of guanidine oligomers or guanidine derivative compounds can be described in structural formula (III) and structural formula (IV) or salts thereof. Superscripts "n" and "m" are each independently an integer from 0-4. "J", "Q", and "Z" are each independently a monocarbocyclic or bicyclic carbocyclic aromatic group which can be substituted by 1 to 5 members such as, but not limited to, hydrogen, hydroxyl, halo, alkoxy, alkyl, amino, carboxy, acetoxy, cyano and sulfhydryl. "G" can be a bivalent $C_1$-$C_{12}$ straight or branched chain alkyl, alkenyl or alkynyl linking group, which can be substituted in the carbon chain by 1 to 4 members such as, but not limited to, O, S, N atoms. In addition, 1 to 12 of the hydrogen atoms on the carbon chain may be replaced independently by a member such as, but not limited to, hydroxyl, halo, alkoxy, alkyl, amino, carboxy, acetoxy, cyano and sulfhydryl. "R" can be a $C_1$-$C_{12}$ straight or branched chain alkyl, alkenyl, alkynyl or alkanoyl group, and 1 to 12 of the hydrogen atoms on the carbon chain may be replaced independently by a member such as but not limited to, hydroxyl, halo, alkoxy, alkyl, amino, carboxy, acetoxy, cyano and sulfhydryl. $R^3$, $R^5$ and $R^7$ are each independently hydrogen or a lower alkyl, while $R^4$, $R^5$, and $R^8$ are each independently hydrogen, alkyl, alkoxy or hydroxyl-substituted alkyl, or a salt thereof.

III

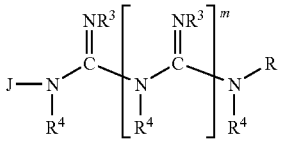

IV

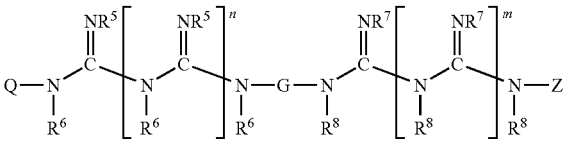

The salts of guanidine polymer compounds 16 include compounds where the anion of the salt is an anion of an organic acid. The anion group can include, but is not limited to, an alkanoyl group (e.g., gluconate or a gluconate derivative), a halide, hydrogen sulfate, an acetate, methane sulfonate, a succinate, a citrate, a malonate, a furarate, an oxylate, or a gluconate or a gluconate derivative.

Some additional embodiments of the guanidine polymer compounds 16 include the structural formulation (III) and structural formulation (IV) as described above, where each of "J", "Q" and "Z" is a member such as, but not limited to, phenyl substituted compound. The phenyl substituted compound can be substituted by 1 to 3 members such as, but not limited to, hydrogen, hydroxyl, halo, alkoxy, alkyl, amino, carboxy, acetoxy, cyano and sulfhydryl. Superscript "n" and "m" are each the integer 1, or a salt thereof.

Additional embodiments of the guanidine polymer compound 16 include the structural formulation (V), where each of "Q" and "Z" is a member such as, but not limited to, phenyl substituted compounds. The phenyl substituted compound can be substituted with 1 to 3 members such as, but not limited to, hydrogen, hydroxyl, halo, alkoxy, alkyl, amino, carboxy, acetoxy, cyano and sulfhydryl. Subscript "p" is an integer from 1-20, or a salt thereof.

V

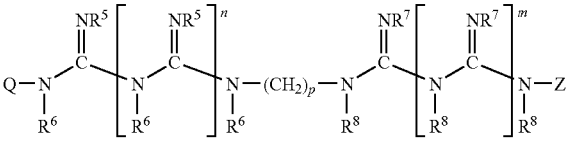

Exemplary embodiments of the guanidine polymer compound 16 include the structural formulation (V), where each of $R^5$, $R^6$, $R^7$, and $R^8$ is hydrogen, "p" is an integer from 4-8, and each of "Q" and "Z" is a phenyl group substituted in the para position by a halo group, or a salt thereof. Additional compounds of structural formulation (V) include compounds where each of "Q" and "Z" is a phenyl group substituted in the para position by a chloro group, "p" is the integer 6, or a salt thereof.

Another preferred embodiment of the guanidine polymer compound 16 includes compounds described by the structural formulation (V), where each of $R^5$ and $R^6$ is hydrogen, "Q" is a phenyl group substituted in the para position by a halo group. In particular, "Q" is a phenyl group substituted in the para position by a chloro group.

Another preferred embodiment of the guanidine polymer compound 16 includes poly($C_{3-18}$-hydrocarbyl]monoguanidine compounds described by the structural formulations (VI and VII) and salts thereof. The subscript "o" is 0 or 1; each Y independently is a $C_{3-18}$ hydrocarbyl group; A and B are hydrocarbyl groups which together comprise a total of 3 to 18 carbon atoms; each $R^9$ independently is hydrogen, substituted alkyl, or substituted alkoxy. In one embodiment, "o" is zero.

VI

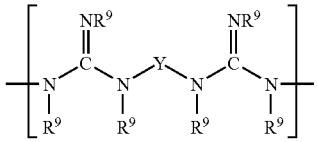

VII

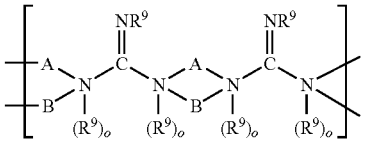

The hydrocarbyl groups in the structural formulations VI and VII and represented by Y, A, and B could be interrupted by one or more hetero atoms or groups and carry one or more substituents other than hydrogen. The interrupting atoms and groups can be —O—, —S—, —NH—, —C(═O)—, and phenylene. The substituents could be hydroxy, $C_{1-4}$-alkoxy, halo (e.g., chloro or bromo), nitro, amino, substituted amino, and acid groups (e.g., carboxy, sulpho phosphate, guanidino and substituted guanidino). In embodiments where the hydrocarbyl group represented by Y, A, or B is an alkylene group it is preferably a straight chain or a branched chain.

In another embodiment, the hydrocarbyl groups in the structural formulations VI and VII and represented by Y are $C_{3-18}$-alkylene (e.g., $C_{4-16}$-alkyene, $C_{6-12}$-alkyene, and $C_6$-alkyene), $C_{3-12}$-arylene (e.g., $C_{6-10}$-arylene, phenylene, and naphthylene, $C_{7-12}$-aralkylene (e.g., $C_{7-11}$-arylene, benzylene, and xylyene), and combinations thereof. The hydrocarbyl groups in the structural formulations VI and VII and represented by Y could be interrupted by one or more —O—, —S—, —NH, and —C(═O)— groups.

In another embodiment, the hydrocarbyl groups represented by A and B are each independently $C_{2-6}$-alkylene, which can be interrupted by one or more —O—, —S—, —NH—, or —C(═O)— groups, with the proviso that A and B include a total of 2 to 12 carbon atoms, 3 to 6 carbon atoms, and 3 or 4 carbon atoms. In another embodiment, the hydrocarbyl groups represented by one of A or B is $—CH_2—$ or $—(CH_2)_2—$ and the other is $—(CH_2)_2—$, while in another embodiment both A and B are $—(CH_2)_2—$.

Illustrative examples of hydrocarbyl groups represented by Y include, but are not limited to, $—CH_2C_6H_4CH_2—$, $—CH_2OC_6H_4OCH_2—$, $—CH_2OC_6H_{10}OCH_2—$, $—(CH_2)_3O(CH_2)_3—$, and $—(CH_2)_2S(CH_2)_2—$. Additional illustrative examples of hydrocarbyl groups represented by Y include, but are not limited to, $—(CH_2)_6—$, $—(CH_2)_8—$, $—(CH_2)_9—$, $—(CH_2)_{12}—$, $—CH_2CH(—CH_3)(CH_2)_4CH_3$, 1,4-, 2,3- and 1,3-butylene, 2,5-hexylene, 2,7-heptylene, 3-methyl-1, and 6-hexylene.

In another embodiment, groups represented by Y are the same and are $C_{4-16}$-alkylene, $C_{4-12}$-alkylene, $C_{4-8}$-alkylene, and 1,6-hexylene.

Each $R^9$ can be H, $CH_3$, $C_{1-4}$-alkyl, $C_{1-4}$-alkoxy, or $C_{1-4}$-alkoxy —OH. In another embodiment, the guanidine polymer compound 16 includes one or more groups of Formula (VIII) or salts thereof, where "t" is 2 to 100, 2 to 50, or 3 to 25.

VIII

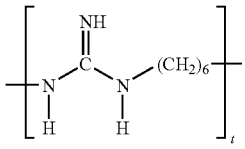

The guanidine polymer compound 16 may be either a single discrete species or a mixture of polymers of varying chain length.

The salt can include, but is not limited to, salts with organic or inorganic acids and water-soluble salts (e.g., gluconate, acetate, phosphate or hydrochloride salts).

The substrate 12 incorporates the guanidine polymer compound 16 in an amount of about 0.1 to 3 grams per meter squared (GSM), about 0.1 to 2 GSM, and about 0.1 to 1 GSM.

The metallic salt 18 can include mono- or multi-valent metallic salts. The metallic salts 18 are soluble in water. The metallic salt 18 can include cations such as, but not limited to, Group I metals, Group II metals, Group III metals, or the transition metals. In particular, the metallic cation can include, but is not limited to, sodium, calcium, copper, nickel, magnesium, zinc, barium, iron, aluminum and chromium ions. In an embodiment, the metallic cation includes calcium, magnesium, and aluminum. The anion species can include, but is not limited to, chloride, iodide, bromide, nitrate, sulfate, sulfite, phosphate, chlorate, acetate ions, and combinations thereof.

Exemplary embodiments of the metallic salt 18 includes, but is not limited to, sodium chloride, aluminum chloride, aluminum bromide, aluminum sulfate, aluminum nitrate, aluminum acetate, barium chloride, barium bromide, barium iodide, barium nitrate, calcium chloride, calcium bromide, calcium iodide, calcium nitrate, calcium acetate, copper chloride, copper bromide, copper sulfate, copper nitrate, copper acetate, iron chloride, iron bromide, iron iodide, iron sulfate, iron nitrate, magnesium chloride, magnesium bromide, magnesium iodide, magnesium sulfate, magnesium nitrate, magnesium acetate, nickel chloride, nickel bromide, nickel sulfate, nickel nitrate, nickel acetate, zinc chloride, zinc bromide, zinc sulfate, zinc nitrate, and zinc acetate. In an embodiment, the metallic salt includes sodium chloride, aluminum chloride, calcium chloride, calcium nitrate, and magnesium chloride.

The substrate 12 incorporates the metallic salt 18 in an amount of about 0.001 to 3 grams per meter squared (GSM), about 0.1 to 2 GSM, about 0.1 to 1 GSM, and about 0.1 to 0.5 GSM.

The substrate 12 can include other components such as, but not limited to, binders, starch, optical brighteners, inorganic or organic filler, sizing agents, anionic reagents, and combinations thereof.

EXAMPLES

Figure 5A:
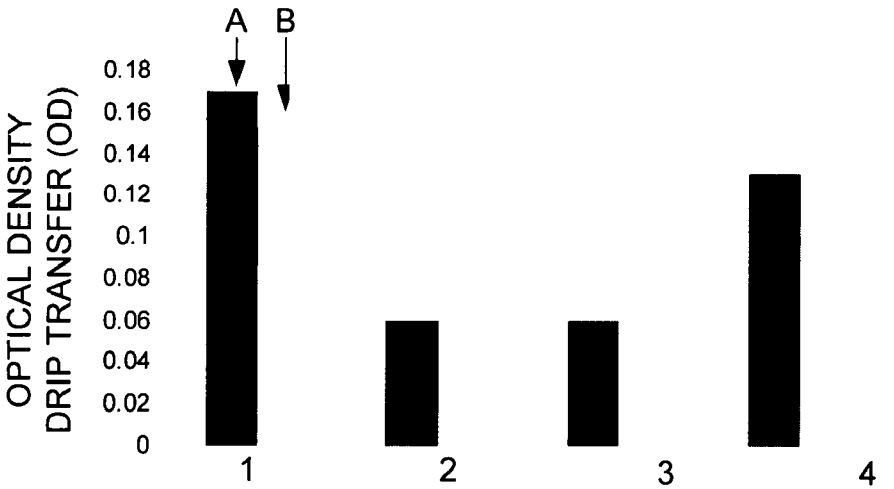
FIGS. 5A and 5B illustrate representative dripfast data obtained using embodiments of the print medium illustrated in FIG. 1.
Figure 5B:
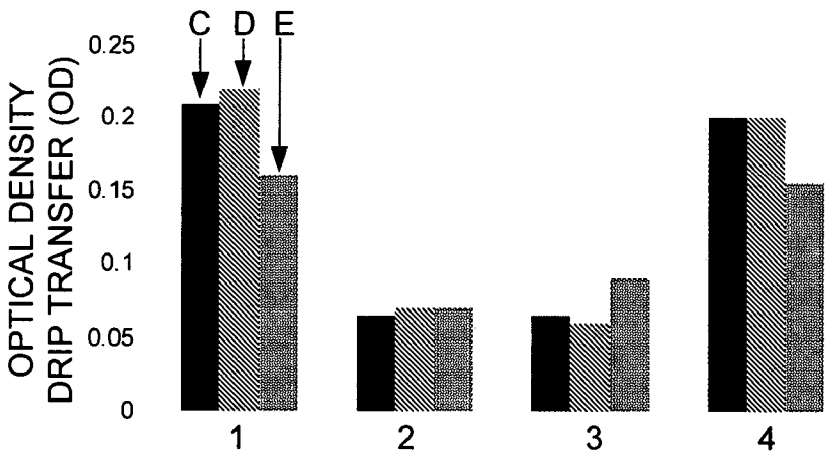

FIGS. 5A and 5B illustrate representative dripfastness data obtained using embodiments of the print medium illustrated in FIG. 1. The image is dripped with 250 microliters of deionized water when the media is set at about a 45-degree angle. Optical density of the dripped non-imaged media just below the image was measured. The optical density of the blank media used in all tests is 0.06. FIG. 5A illustrates optical density of drip transfer of two inks dispensed onto three print media of the present disclosure (e.g., including guanidine polymer compounds and/or metallic salt) compared to the same inks disposed onto a control print medium without including guanidine/metallic salt as a function of optical density. The three print media have the following compositions: 1) 3% $CaCl_2$, 2) 3% polyguanadine, and 3) 3% $CaCl_2$+3% polyguanadine, while the remainder of the print medium is composed of fibrous material, optical brighteners, starch, and the like. The control print medium 4) is composed of fibrous material, optical brighteners, starch, and the like, but does not include guanidine polymer compounds or metallic salt. The dye-based inks used to test the print medium include OfficeJet G85 cyan ink (A) and Business InkJet 3000 cyan ink (B).

The results show that the addition of the guanidine polymer compounds (respectively print media 2 and 3) reduces the drip transfer as compared to print medium 4 without guanidine polymer compounds and/or metallic salt.

FIG. 5B illustrates optical density of drip transfer of three inks disposed onto the three print media and the control print medium, as described above, as a function of media type. The results show that the addition of the guanidine polymer compounds and/or the metallic salt to the print medium (respectively print media 2 and 3) reduces drip transfer as compared to print medium 4 without guanidine polymer compounds and/or metallic salt. The dye-based inks used to test the print medium include DJ5500 magenta ink (C), OfficeJet G85 magenta ink (D), and Business InkJet 3000 magenta ink (E).

Figure 6:
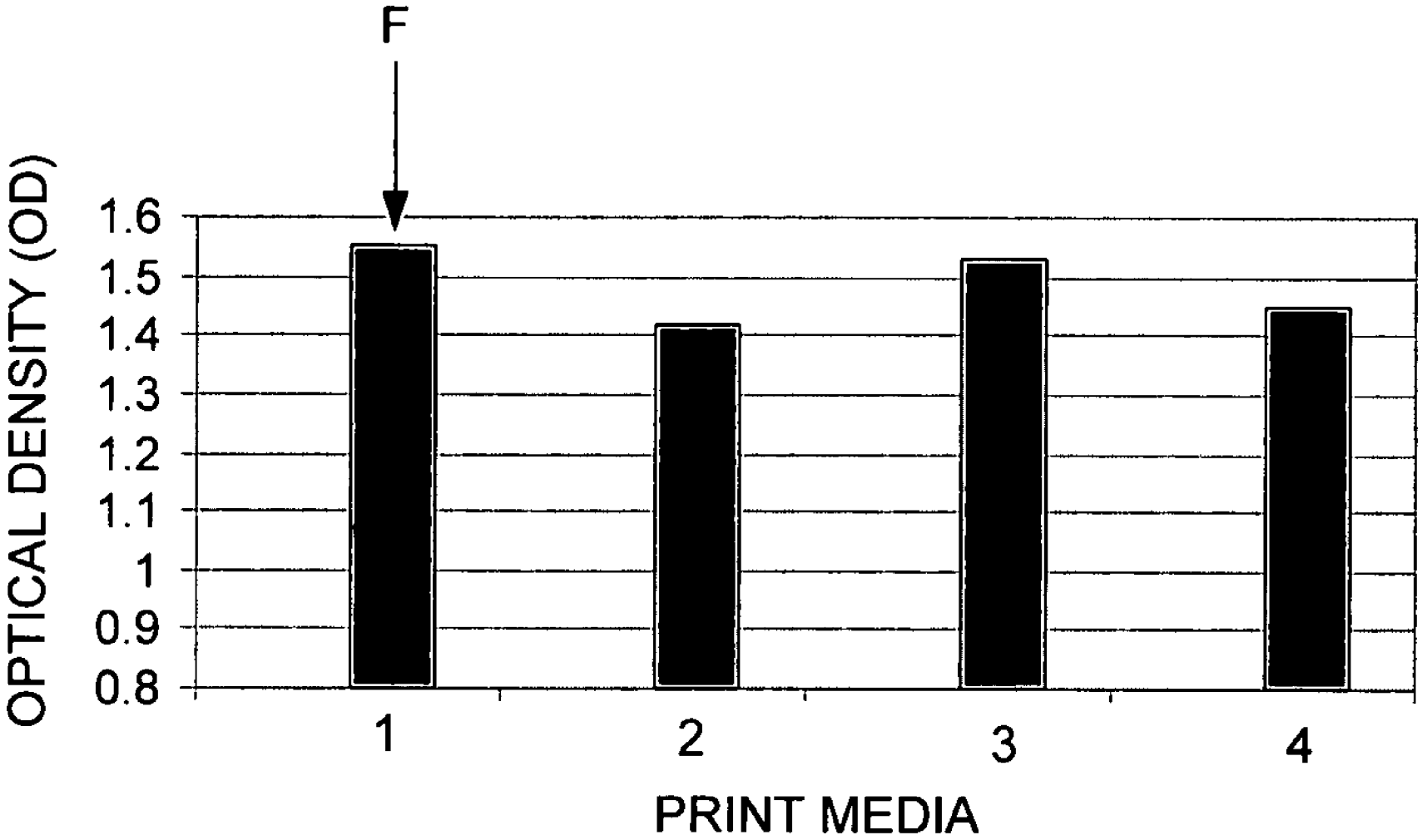
FIG. 6 illustrates a representative optical density data obtained using embodiments of the print medium illustrated in FIG. 1.

FIG. 6 illustrates a representative optical density data of the printed area obtained using embodiments of the print medium illustrated in FIG. 1. FIG. 6 illustrates optical density of an ink disposed onto the three print media and the control print medium, as described above, as a function of media type. The inks used to test the print medium include DJ5500 black pigment-based ink (F). The results show that the addition of the guanidine polymer compounds and/or the metallic salt to the print medium shows about equal or higher optical density as compared to print medium 4 without guanidine polymer compounds and/or metallic salt.

Many variations and modifications may be made to the above-described embodiments. All such modifications and variations are intended to be included herein within the scope of this disclosure and protected by the following claims.

At least the following is claimed:

1. A method of forming print media, comprising:

providing a fibrous material including a plurality of fibers;

introducing a guanidine polymer component and a metallic salt to the fibrous material, wherein said guanidine polymer component contains a cationic guanidine polymer compound or salt thereof, and wherein the metallic salt is selected from the group consisting of sodium chloride, calcium chloride, calcium nitrate, and magnesium chloride;

mixing the guanidine polymer component and the metallic salt with the fibrous material;

forming a substrate having a surface and a fibrous component comprising said plurality of fibers, wherein the guanidine polymer component and the metallic salt are disposed within and among said fibers, wherein the cationic guanidine polymer compound is selected from the group consisting of polymers containing at least two monomer groups described by structural formula (I), polymers including at least two monomer groups described by structural formula (II), and guanidine oligomers or guanidine derivative compounds described by any of structural formulas (III)-(VIII), wherein structural formula (I) is:

I

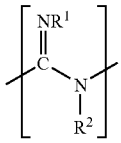

wherein, in formula (I), $R^1$ is hydrogen or a lower alkyl and $R^2$ is hydrogen, an alkyl, an alkoxy, or a hydroxyl-substituted alkoxy;

wherein structural formula (II) is:

II

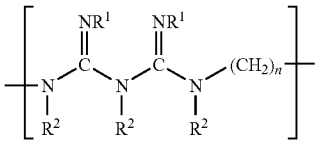

wherein, in formula (II), "n" is an integer in the range of 1 to 10, $R^1$ is hydrogen or a lower alkyl and $R^2$ is hydrogen, an alkyl, an alkoxy, or a hydroxyl-substituted alkoxy;

wherein structural formula (III) is:

III

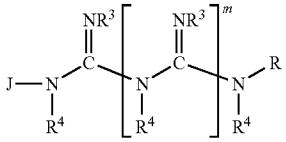

wherein, in formula (III), "m" is an integer from 1-4, "J" is a monocarbocyclic or bicyclic carbocyclic aromatic group or phenyl group, each "R" is a branched chain alkyl, alkenyl, alkynyl or alkanoyl group, each $R^3$ is independently hydrogen or a lower alkyl, while each $R^4$ is independently hydrogen, alkyl, alkoxy or hydroxyl-substituted alkyl;

wherein structural formula (IV) is:

IV

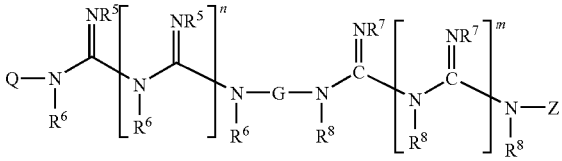

wherein, in formula (IV), "n" and "m" are each independently an integer from 1-4, "Q", and "Z" are each independently a monocarbocyclic or bicyclic carbocyclic aromatic group or phenyl group, "G" is a bivalent $C_1$-$C_{12}$ branched chain alkyl, alkenyl or alkynyl linking group, $R^6$ and $R^7$ are each independently hydrogen or a lower alkyl, while $R^6$ and $R^8$ are each independently hydrogen, alkyl, alkoxy or hydroxyl-substituted alkyl;

wherein structural formula (V) is:

V

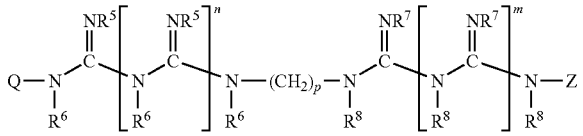

wherein "n" and "m" are each independently an integer from 1-4, "p" is an integer from 4-8, each of "Q" and "Z" is a phenyl group substituted in the para position by a halo group, $R^5$ and $R^7$ are each independently hydrogen or a lower alkyl, while $R^6$ and $R^8$ are each independently hydrogen, alkyl, alkoxy or hydroxyl-substituted alkyl;

wherein structural formula (VI) is:

VI

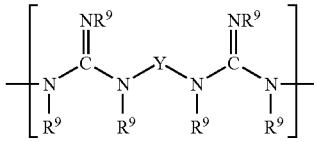

wherein "Y" is a $C_{3-18}$ hydrocarbyl group having at least one interrupting group selected from the group consisting of —O—, —S—, —NH—, —C(=O)—; each $R^9$ is independently hydrogen or a substituted alkyl or substituted alkoxy wherein the substituents are selected from the group consisting of hydroxy, $C_{1-4}$-alkoxy, halogen, nitro, amino, substituted amino, and acid groups;

wherein structural formula (VII) is:

VII

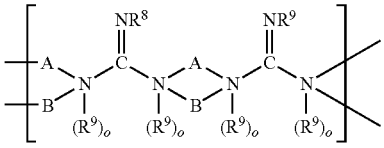

wherein "A" and "B" are each a hydrocarbyl group or a hydrocarbyl group including a hetero atom; each $R^9$ is independently hydrogen or a substituted alkyl or substituted alkoxy wherein the substituents are selected from the group consisting of hydroxy, $C_{1-4}$-alkoxy, halogen, nitro, amino, substituted amino, and acid groups; and subscript "o" is 0 or 1;

wherein structural formula (VIII) is:

VIII

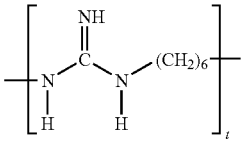

wherein "t" is 2 to 100.

2. The method of claim 1, wherein the cationic guanidine polymer compound contains at least two monomer units, wherein each said monomer unit is described by structural formula (I).

3. The method of claim 1, wherein the cationic guanidine polymer compound contains at least two monomer units, wherein each said monomer unit is described by structural formula (II).

4. The method of claim 1, wherein the cationic guanidine polymer compound is described by structural formula (III).

5. The method of claim 1, wherein the cationic guanidine polymer compound is described by structural formula (IV).

6. The method of claim 1, wherein the cationic guanidine polymer compound is described by structural formula (V).

7. The method of claim 1, wherein the cationic guanidine polymer compound includes at least one group of structural formula (VI).

8. The method of claim 1, wherein the cationic guanidine polymer compound is described by structural formula (VII).

9. The method of claim 1, wherein the cationic guanidine polymer compound is described by structural formula (VIII).

10. The method of claim 9 wherein said cationic guanidine polymer component comprises a mixture of cationic guanidine polymers of different chain lengths in the range of t=2-200, wherein each polymer is described by structural formula (VIII).

11. The method of claim 1, wherein the metallic salt is calcium chloride.

12. The method of claim 1, wherein mixing the cationic guanidine polymer compound or salt thereof and the metallic salt with the fibrous component comprises incorporating an amount of said guanidine polymer compound sufficient to yield about 0.1 to about 3 grams per meter squared in the substrate.

13. The method of claim 1, wherein mixing the cationic guanidine polymer compound or salt thereof and the metallic salt with the fibrous component comprises incorporating an amount of said metallic salt sufficient to yield about 0.001 to about 3 grams per meter squared in the substrate.

14. A print medium comprising:

a substrate comprising a fibrous component containing fibers, a metallic salt, and a cationic guanidine polymer compound described by structural formula (VII),

VII

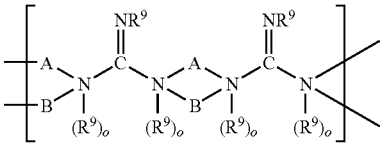

wherein "A" and "B" are each a hydrocarbyl group or a hydrocarbyl group including a hetero atom; each $R^9$ is independently hydrogen or a substituted alkyl or substituted alkoxy wherein the substituents are selected from the group consisting of hydroxy, $C_{1-4}$-alkoxy, halogen, nitro, amino, substituted amino, and acid groups; and subscript "o" is 0 or 1;

or a salt thereof, wherein said cationic guanidine polymer compound and said metallic salt are each disposed within and among said fibers.

15. The print medium of claim 14, wherein said substrate contains the cationic guanidine polymer compound, or salt thereof, in an amount of about 0.1 to about 3 grams per meter squared.

16. The print medium of claim 14, wherein said substrate contains the metallic salt in an amount of about 0.001 to about 3 grams per meter squared.

17. The print medium of claim 14, wherein the metallic salt is selected from the group consisting of sodium chloride, aluminum chloride, calcium chloride, calcium nitrate, and magnesium chloride.

18. The print medium of claim 14, wherein the metallic salt is sodium chloride.

19. The print medium of claim 14, wherein the metallic salt is aluminum chloride.

20. The print medium of claim 14, wherein the metallic salt is calcium chloride.

21. The print medium of claim 14, wherein the metallic salt is calcium nitrate.

22. The print medium of claim 14, wherein the metallic salt is magnesium chloride.

23. The print medium of claim 14 further comprising a surface sizing composition deposited on said substrate, wherein said surface sizing composition comprises a cationic guanidine polymer compound.

24. The print medium of claim 14, wherein the substrate is selected from the group consisting of printing paper, writing paper, drawing paper and photobase paper.

25. A print medium comprising:

A substrate containing a surface and a fibrous component containing fibers and a cationic guanidine polymer compound containing at least two monomers, each said monomer described by structural formula (I) or (II), or a salt thereof, and sodium chloride are each disposed within and around said fibers in said fibrous component, wherein structural formula (I) is:

I

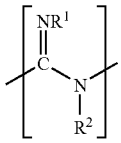

wherein, in formula (I), $R^1$ is hydrogen or a lower alkyl and $R^2$ is hydrogen, an alkyl, an alkoxy, or a hydroxyl-substituted alkoxy; and wherein structural formula (II) is:

II

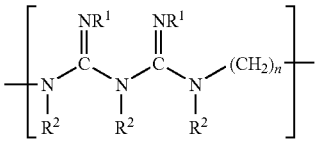

wherein, in formula (II), "n" is an integer in the range of 1 to 10, $R^1$ is hydrogen or a lower alkyl and $R^2$ is hydrogen, an alkyl, an alkoxy, or a hydroxyl-substituted alkoxy.

26. The print medium of claim 25 wherein said cationic guanidine polymer compound contains at least two monomers, each said monomer described by structural formula (I) wherein $R^1$ is hydrogen and $R^2$ is hydrogen.

27. The print medium of claim 25 wherein said cationic guanidine polymer compound contains at least two monomers, each said monomer described by structural formula (II) wherein "n" is 6, $R^1$ is hydrogen and $R^2$ is hydrogen.

28. A method of forming print media, comprising:

providing a fibrous material including a plurality of fibers;

introducing a guanidine polymer component and a metallic salt to the fibrous material, wherein said guanidine polymer component contains a cationic guanidine polymer compound or salt thereof;

mixing the guanidine polymer component and the metallic salt with the fibrous material;

forming a substrate having a surface and a fibrous component comprising said plurality of fibers, wherein the guanidine polymer component and the metallic salt are disposed within and among said fibers, wherein the cationic guanidine polymer compound is selected from the group consisting of polymers containing at least two monomer groups described by structural formula (I), polymers including at least two monomer groups described by structural formula (II), and guanidine oligomers or guanidine derivative compounds described by any of structural formulas (III)-(VIII), wherein structural formula (I) is:

I

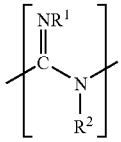

wherein, in formula (I), $R^1$ is hydrogen or a lower alkyl and $R^2$ is hydrogen, an alkyl, an alkoxy, or a hydroxyl-substituted alkoxy;

wherein structural formula (II) is:

II

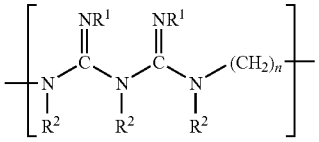

wherein, in formula (II), "n" is an integer in the range of 1 to 10, $R^1$ is hydrogen or a lower alkyl and $R^2$ hydrogen, an alkyl, an alkoxy, or a hydroxyl-substituted alkoxy;

wherein structural formula (III) is:

III

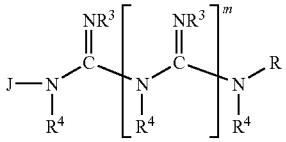

wherein, in formula (III), "m" is an integer from 1-4, "J" is a monocarbocyclic or bicyclic carbocyclic aromatic group or phenyl group, each "R" is a branched chain alkyl, alkenyl, alkynyl or alkanoyl group, each $R^3$ is independently hydrogen or a lower alkyl, while each $R^4$ is independently hydrogen, alkyl, alkoxy or hydroxyl-substituted alkyl;

wherein structural formula (IV) is:

IV

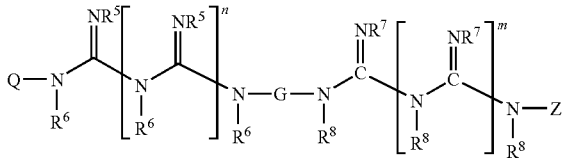

wherein, in formula (IV), "n" and "m" are each independently an integer from 1-4, "Q", and "Z" are each independently a monocarbocyclic or bicyclic carbocyclic aromatic group or phenyl group, "G" is a bivalent $C_1$-$C_{12}$ branched chain alkyl, alkenyl or alkynyl linking group, $R^5$ and $R^7$ are each independently hydrogen or a lower alkyl, while $R^6$ and $R^8$ are each independently hydrogen, alkyl, alkoxy or hydroxyl-substituted alkyl;

wherein structural formula (V) is:

V

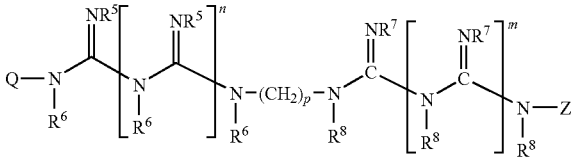

wherein "n" and "m" are each independently an integer from 1-4, "p" is an integer from 4-8, each of "Q" and "Z" is a phenyl group substituted in the para position by a halo group, $R^5$ and $R^7$ are each independently hydrogen or a lower alkyl, while $R^6$ and $R^8$ are each independently hydrogen, alkyl, alkoxy or hydroxyl-substituted alkyl;

wherein structural formula (VI) is:

VI

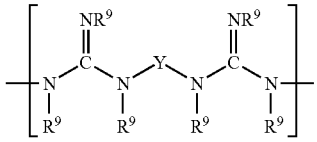

wherein "Y" is a $C_{3-18}$ hydrocarbyl group having at least one interrupting group selected from the group consisting of —O—, —S—, —NH—, —C(═O)—; each $R^9$ is independently hydrogen or a substituted alkyl or substituted alkoxy wherein the substituents are selected from the group consisting of hydroxy, $C_{1-4}$-alkoxy, halogen, nitro, amino, substituted amino, and acid groups;

wherein structural formula (VII) is:

VII

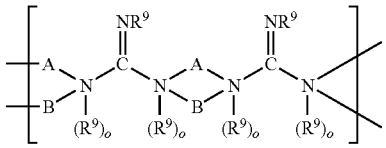

wherein "A" and "B" are each a hydrocarbyl group or a hydrocarbyl group including a hetero atom; each $R^9$ is independently hydrogen or a substituted alkyl or substituted alkoxy wherein the substituents are selected from the group consisting of hydroxy, $C_{1-4}$-alkoxy, halogen, nitro, amino, substituted amino, and acid groups; and subscript "o" is 0 or 1;

wherein structural formula (VIII) is:

VIII

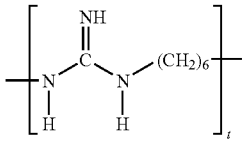

wherein "t" is 2 to 100; and applying a surface sizing composition containing said cationic guanidine polymer compound or salt thereof and a metallic salt onto said substrate.

* * * * *

UNITED STATES PATENT AND TRADEMARK OFFICE

CERTIFICATE OF CORRECTION

PATENT NO. : 7,553,395 B2
APPLICATION NO. : 10/817141
DATED : June 30, 2009
INVENTOR(S) : John L Stoffel et al.

It is certified that error appears in the above-identified patent and that said Letters Patent is hereby corrected as shown below:

In column 7, line 41, delete "phosphate" and insert -- phosphato --, therefor.

In column 10, lines 55-60, in formula IV, in Claim 1, delete

" 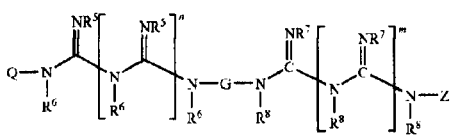 " and insert -- 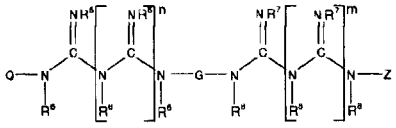 --, therefor.

In column 15, lines 5-10, in formula IV, in Claim 28, delete

" 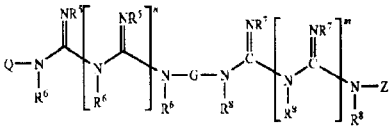 " and insert -- 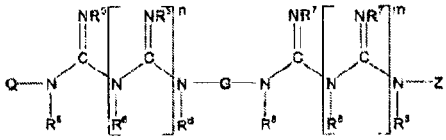 --, therefor.

In column 15, lines 25-30, in formula V, in Claim 28, delete

" 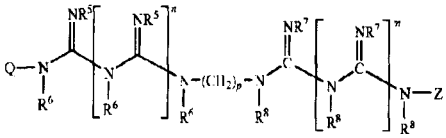 " and insert -- 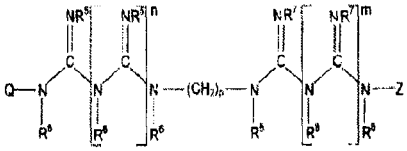 --, therefor.

Signed and Sealed this

Twenty-second Day of June, 2010

David J. Kappos

David J. Kappos
*Director of the United States Patent and Trademark Office*